United States Patent [19]

Lanning

[11] Patent Number: 4,481,561

[45] Date of Patent: Nov. 6, 1984

[54] GUN BORE SIGHTING FLASHLIGHT ACTIVATED UPON BREECH CLOSURE

[75] Inventor: Charles T. Lanning, Watertown, S. Dak.

[73] Assignee: Site-Lite, Inc., Jamestown, N. Dak.

[21] Appl. No.: 462,786

[22] Filed: Feb. 1, 1983

[51] Int. Cl.[3] ..... F41G 1/34; F21L 7/00

[52] U.S. Cl. ..... 362/111; 362/206; 362/802; 362/191

[58] Field of Search ..... 362/110, 111, 191, 206, 362/202, 112, 205, 802

[56] References Cited

U.S. PATENT DOCUMENTS

| | | | |
|---|---|---|---|
| 1,066,386 | 7/1913 | De Zeng | 362/206 X |
| 1,490,272 | 4/1924 | Hickam . | |
| 1,645,881 | 10/1927 | Strong . | |
| 1,795,401 | 3/1931 | Lawrence | 362/111 |
| 2,070,316 | 2/1937 | Recker | 362/206 |
| 2,779,344 | 1/1957 | Hemmings et al. | 262/206 X |
| 2,894,116 | 7/1959 | Koskey . | |
| 2,928,190 | 3/1960 | Evans . | |
| 3,471,945 | 10/1969 | Fleury . | |
| 4,048,489 | 9/1977 | Giannetti | 362/110 |

FOREIGN PATENT DOCUMENTS

| | | | |
|---|---|---|---|
| 1350575 | 4/1974 | United Kingdom | 42/1 A |

*Primary Examiner*—Richard E. Schafer
*Assistant Examiner*—John S. Maples
*Attorney, Agent, or Firm*—Peterson, Palmatier, Sturm, Sjoquist & Baker, Ltd.

[57] ABSTRACT

A flashlight for bore sighting a long barreled shotgun or rifle including a cartridge case with an ejector rim and a primer opening in the base, and a sidewall defining an open front end; a battery and a light bulb within the case; a switch pin slidable in the primer opening to complete the circuit for illuminating the bulb, a spring normally urging the switch pin outwardly and a metallic bulb holder adjacent the front of the case; in a shotshell case, the bulb holder having a frame shank extending along the battery and to the base thereof, the shank having an apertured flange at the base of the battery, spaced from the battery by an insulator and the hole in the flange aligned with the switch pin.

6 Claims, 6 Drawing Figures

GUN BORE SIGHTING FLASHLIGHT ACTIVATED UPON BREECH CLOSURE

This invention relates to a bore sighting flashlight and more particularly to a combined flashlight and cartridge case insertable into the shell chamber, or breech, of a rifle, shotgun or pistol.

BACKGROUND OF THE INVENTION

It is important to check the sights of a shotgun or rifle to be assured that when the gun is fired, the shot pattern or bullet will be directed at the same place that is visible in the sights of the gun. It has not been common practice in the past to sight in a shotgun, and usually the person using the shotgun simply relies on the original construction of the gun and sights or the preliminary setting of the sights made by the factory and does not further concern himself with the sights. It is all the more important to sight in a rifle because there is only a single projectile or bullet which must hit the mark at which the shot is being taken.

Bore sighting has traditionally been accomplished by removing the bolt of a rifle, peering through the bore of the rifle to a mark or target; and then, without moving the rifle, peering through or over the sights to the mark or another mark, making allowances for elevation and windage.

Such bore sighting is more difficult with rifles and shotguns that do not have a removable bolt, such as autoloading guns and slide action repeaters, wherein the breech is enclosed and the peering into the shell chamber is not possible except through the use of mirrors.

SUMMARY OF THE INVENTION

An object of the invention is to provide a new and improved tool for use with shotguns, rifles and pistols for aiding in the sighting of such guns.

Another object of the invention is to provide a new and novel combined flashlight and cartridge case insertable into the shell chamber of a gun to cast a beam of light down the barrel of the gun, providing an illuminated mark on a wall surface against which the sights may be adjusted.

A feature of the present invention is a cartridge case to fit snugly into the shell chamber in the breech of a gun, and in the same identical position in which a cartridge will be confined in the chamber. The cartridge case includes a battery holder or frame which also mounts a light bulb; and a switch pin which operates to close the circuit for the bulb and cause the bulb to be illuminated whenever tne breech of the gun is closed. The switch pin is located in the primer hole in the cartridge case and is normally spring pressed away from the battery. The switch pin is preferably hollow so that the firing pin in the breech bolt of the gun will align with the opening in the switch pin and thereby avoid engaging the switch pin if the firing pin should be released and driven forwardly by its spring to the shell chamber.

The invention provides the advantage of causing the light to be directed along the barrel of the gun and out through the muzzle of the barrel so as to cast an image onto a wall surface and thereby accommodate adjusting the sights of the gun to the image. The light will be illuminated whenever the breech of the gun is closed, either by the bolt of the gun or simply by closing the rear of the shell chamber by the frame of the gun, as in a single shot or double barrel shotgun wherein the barrel tilts with respect to the breech.

The invention also provides the advantage of providing a highly directional signaling light which can be sighted by pointing the barrel of the gun in the proper direction so that a person may receive the signal at a long distance away because the signaling light may be pointed with extreme accuracy.

DETAILED SPECIFICATION

Figure 1:
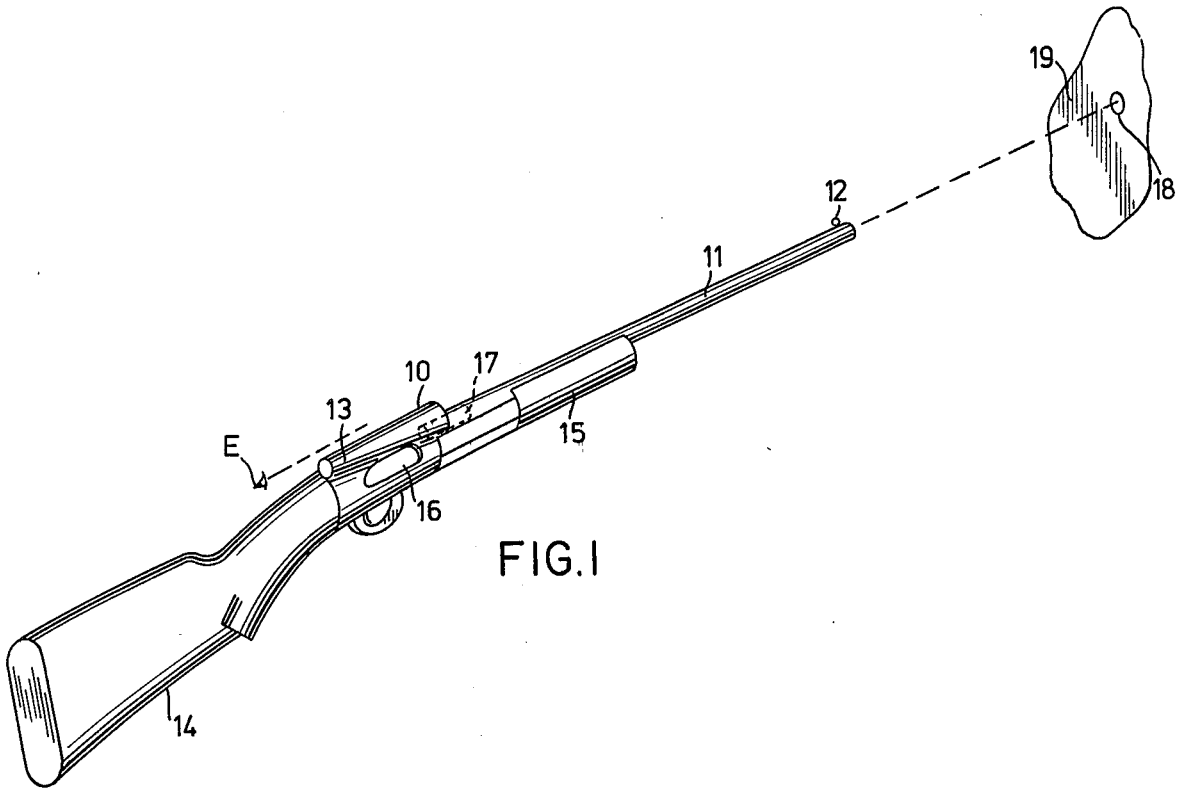
FIG. 1 is a perspective view of a modern shotgun containing the bore sighting flashlight therein and casting an image from the barrel onto a wall or other surface.

FIG. 1 shows a typical shotgun, indicated in general by numeral 10, having a barrel 11, with a front sight 12 thereon, a breech assembly 13, a stock 14, and a slide assembly 15 for operating the bolt 15.1 in the breech assembly for the purpose of closing the cartridge chamber 11.1, ejecting a spent cartridge and loading a fresh cartridge into the shell chamber of the gun. A firing pin 15.3 in the bolt is aligned with the center of the chamber 11.1 of the barrel. An ejector hook 15.2 will withdraw the cartridge from the cartridge chamber 11.1 in the barrel. The breech assembly 13 has an ejection opening 16 in its side through which spent cartridge cases are ejected.

FIG. 1 shows the bore sighting flashlight 17 in the shell chamber at the rear end of the barrel 11 and casting a beam of light along the bore 11.2 of the barrel and an image of light 18 onto a wall surface 19 to accommodate sighting in the shotgun. It will be appreciated that the rear sight of the shotgun is usually provided by the top of the breech assembly 13, but in many shotguns, a rib is extended along the barrel to provide a substantially continuous sight. The person's eye should sight along the top of the barrel or sight of the gun and see the image 18 in predetermined relation to the sight.

Figure 2:
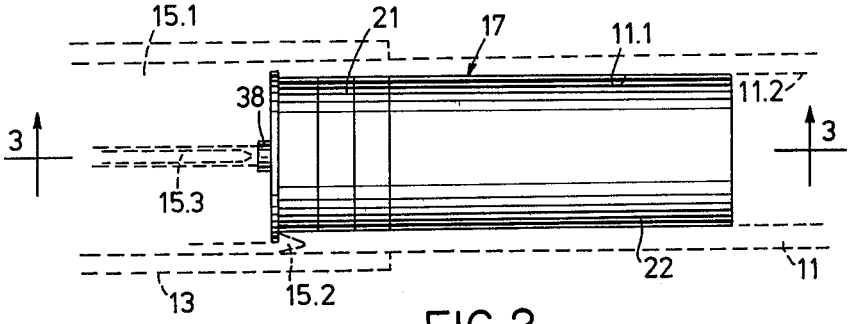
FIG. 2 is an elevation view of the bore sighting flashlight.
Figure 3:
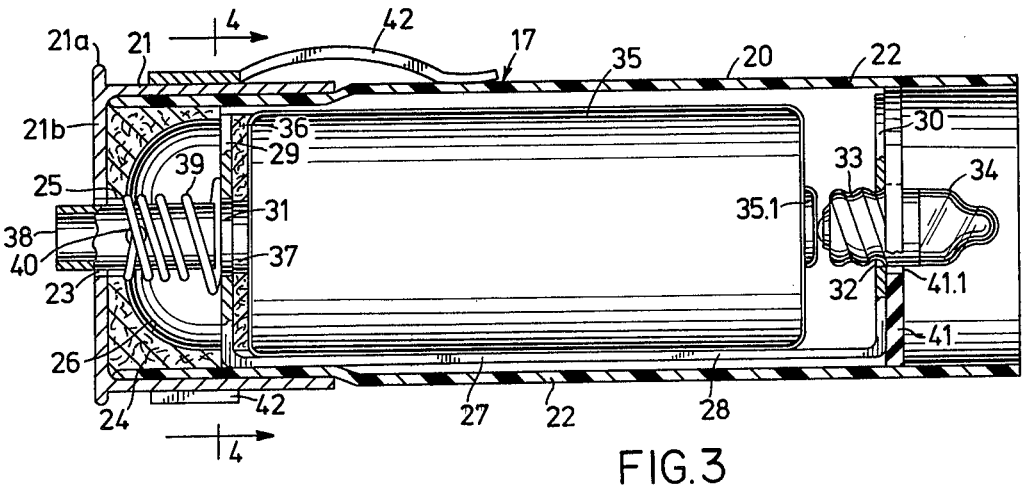
FIG. 3 is an enlarged longitudinal section view taken approximately at 3—3 of FIG. 2.
Figure 4:
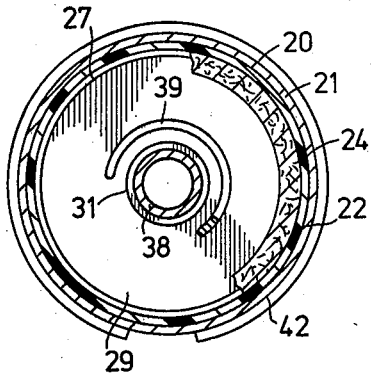
FIG. 4 is a detail section view taken approximately at 4—4 of FIG. 3.

One form of bore sighting flashlight 17 is illustrated in FIGS. 2, 3 and 4. The flashlight includes a shotshell case 20, which includes a metal or brass base cap 21 with a rim **21*a* around its rear periphery; and also includes a plastic case wall 22, the rear end of which is affixed into the base cap 21. The rim 21*a* will engage the end of the barrel to control the depth to which the flashlight is inserted into the chamber 11.1, and the rim is also used to withdraw or eject the flashlight from the chamber 11.1. The transverse base wall 21*b* of the base cap 21 has an opening 23** therein which normally receives the primer of the shotshell. The primer, not illustrated, is the part of the shotshell which is impacted by the firing pin of the gun so as to set off the charge and cause the cartridge to fire, thereby directing the missile or shot charge down the barrel of the gun.

The cartridge case 17 also includes a base wad 24 located in the bottom of the interior of the cartridge case and also having an opening 25 through which the primer normally extends. The base wad 24 has a large open bowl shaped area 26 therein, in which the powder charge of a shotshell will be confined.

The flashlight 17 includes a metal battery and bulb holder, or frame, 27, which includes an elongate frame shank 28, and having a base flange 29 at one end thereof and a bulb mounting flange 30 at the other end thereof. In FIG. 4, the base flange 29 is seen to have an annular shape, with a hole 31 in the center of it. The bulb mounting flange 30 is almost identically shaped to the flange 29, and both the flanges 29 and 30 lie transverse to the elongate shank 28 of the battery holder 27. The flange 30 has an opening 32 at its center and into which the threaded base 33 of a flashlight bulb 34 is threaded.

A dry cell flashlight battery 35 is confined in the holder 27, between the two flanges 29 and 30 thereof. The tip 35.1 of the battery engages the central contact of the bulb 34. The base end of the battery 35 is maintained in spaced relation with the flange 29 by an insulating annular fiber washer 36, which has a center hole 37 therein and aligned with the opening 31 in the base flange 29.

A tubular switch pin 38 extends through the primer opening 23 in the base cap and extends into close proximity with the base flange 29 of the battery holder. A coil spring 39 embraces the switch pin 38 and has one end bearing against the base flange 29 of the battery holder; and has its other end secured to the switch pin 38 in electrical contact therewith. In the form illustrated, the spring 39 is connected to the switch pin 38 by a notch or aperture in the switch pin, but of course a spot of solder could also provide the same function of anchoring the spring to the switch pin. The spring 39 is shown extended into the aperture 40 in the side of the switch pin. In the use and operation of the bore sighting flashlight, the flashlight may be operated simply by pressing on the end of the switch pin 38, causing its inner end to move through the openings 31 and 37 to engage the rear or base end of the battery 35. This will complete the circuit to the bulb and battery and cause the bulb to be illuminated. The bulb 34 preferably has directional characteristics as to cast an image with a substantial degree of focus as a spotlight.

The battery holder 27, together with the battery 35 and bulb 34, are retained in the cartridge case 20 by a resilient rubber washer 41 adjacent the open end of the shell case 21 and lying against the flange 30. The washer 41 has a central opening 41.1 through which the light bulb 34 extends; and the outer periphery of the washer 41 makes a friction fit with the inner periphery of the plastic wall 22 as to retain the battery holder 27 and the other parts in the shell case. Of course there may be other ways of retaining the battery holder 27 in the shell case and the end flange 30 may be made large enough as to produce a friction fit by itself to retain the entire assembly together. Otherwise, it may be desirable to use a mechanical fastener to retain the battery holder in the case or to partially crimp the end of the case wall 22. The flashlight 17 is provided with a removable clip 42, which grips the case 20 to retain the flashlight in a person's shirt pocket. Of course, the clip 42 is removed before inserting the flashlight into a shotgun.

In the use of the flashlight 17, the flashlight may be operated by hand by simply pressing the switch pin 38 through the openings 31 and 37 to complete the electrical circuit through the base end of the battery and through the spring, switch pin 38 and base flange 29 so as to illuminate the bulb 34, thereby casting an image therefrom.

When the flashlight is used with the shotgun 10, the breech assembly is opened and the flashlight will be inserted into the shell chamber at the rear end of the barrel and then the breech assembly is closed, causing the bolt or rear closure of the breech to bear against the rear of the flashlight, causing the flashlight to be deeply seated into the chamber of the barrel. Simultaneously with closing the breech, the bolt of the breech assembly will bear against the switch pin 38 and turn the flashlight on, causing an image to be projected down the barrel and cast against a wall or other surface. The sights on the gun may then be aligned with the image 18 on the wall and be suitably adjusted.

It will also be understood that the flashlight, when inserted into the breech of the gun and turned on by closing the bolt against the back of the cartridge case, will produce an extremely accurate signaling device which may be sighted upon a distant location to draw the attention of people at an extreme distance.

Figure 5:
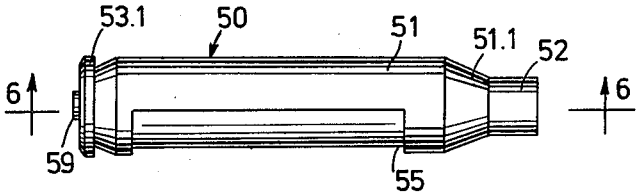
FIG. 5 is an elevation view of a modified form of the invention.
Figure 6:
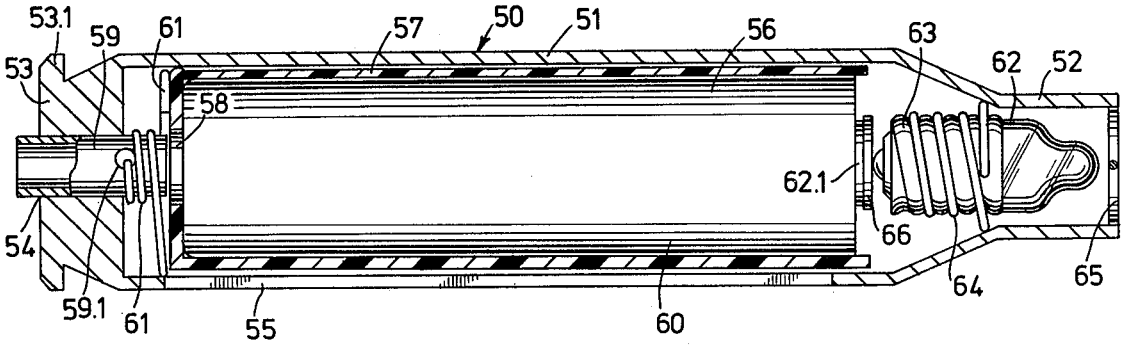
FIG. 6 is a longitudinal section view taken approximately at 6—6 of FIG. 5.

In the form of the invention illustrated in FIGS. 5 and 6, the bore sighting flashlight 50 is made from the case 51 of a large bore rifle in a caliber such as 30-30 or 30/06. The brass case 51 is necked down at its front end 52 to normally receive the 30 caliber bullet. The tapered shoulder 51.1 conforms to the shape of the cartridge chamber in the gun barrel and controls the depth to which the case will be seated into the cartridge chamber. The base end 53 has a primer opening 54 therein, and has a rim 53.1 to which the ejector in the breech assembly attaches for withdrawing the case from the chamber.

In this form, the sidewall of the brass case has a window 55 formed therein to accommodate insertion of the battery 56 which is contained in an insulating cup shaped jacket 57. The bottom wall of the jacket 57 has an opening 58 therein through which the switch pin 59 may be moved to engage and electrically contact the base end of the battery 60.

In this form, the switch pin 59 electrically contacts the base wall 53 of the shell casing and has a sliding relationship to this base wall 53. A coil spring 61 bears against the bottom of the cup shaped insulating jacket 57, but preferably also bears outwardly against the inner periphery of the conductive sidewall of the cartridge case. The other end of the coil spring 61 is anchored to the switch pin, by being crimped into a notch or aperture 59.1 of the switch pin.

A flashlight bulb 62 has its threaded base end 63 embraced by a coil spring 64, one end of which also bears against the tapered, necked down portion of the shell case so as to retain the bulb against the tip end of the battery 56. The base contact 62.1 of the bulb confronts the battery contact tip 56.1 to be engaged thereby. In FIG. 6, a switching element or chip 66 is removably inserted between the base contact 62.1 of the bulb and the battery tip 56.1 and will produce flashing or blinking of the bulb. The front end of the shell case 51 has a cross hair assembly 65 therein so that the image cast by the bore sighting flashlight from the gun barrel contains a cross hair which will fit in accurate sighting, using the sight of the gun.

It will be recognized that either the bulb 34 or 62 may incorporate a flashing switch so that a flashing image may be cast from the gun barrel; or the circuit tip may be provided between the light bulb and battery to produce such a blinking effect. The form of flashlight illustrated in FIGS. 5 and 6 may be inserted into the breech of a high powered rifle, and the flashlight will be turned on and the light 62 illuminated whenever the breech bolt of the rifle is closed behind the flashlight. The open end of the switch pin 59 aligns with the firing pin in the breech bolt of the gun so that in the event the firing pin is accidentially released, the firing pin will not engage any part of the flashlight, but will simply protrude slightly into the opening of the tubular switch pin 59.

It will be seen that I have provided a new and improved bore sighting flashlight incorporating a standard cartridge case and confining a battery and bulb both securely mounted in the case and a flashlight controlling switch pin in the primer opening of the case so that the flashlight is illuminated whenever inserted into the breeeh of the gun and the breech bolt is closed against the end of the flashlight. The flashlight is ejected from the breech of the gun whenever the bolt is opened in the conventional way that a spent cartridge is ejected from the gun.

I claim:

1. A gun bore sighting flashlight for insertion into the cartridge chamber of a gun barrel, said gun including a breech assembly, comprising a cartridge case to fit snugly into the chamber and having an open front end and a closed rear end with a primer opening therethrough, said cartridge case being of the size and shape of an ammunition cartridge for the chamber, flashlight means within the cartridge case for casting a beam of light axially forwardly from the front end of the case, said flashlight means including a bulb at the open front end of the case and a conductive holder mounting the bulb in stationary position, a battery in the case and behind the bulb, an insulator traversing the base of the battery and having a central aperture therein, and movable means consisting of two elements for completing a circuit connected with the bulb and battery for illumination of the bulb, one of said elements being a switch pin in the primer opening and guided by the walls of the primer opening for sliding movement therethrough, and the other of said elements being a spring normally biasing the switch pin to project outwardly of the rear of the case, the spring having one end anchored within the case in continuous circuit connected relationship and the other end anchored to the switch pin so that inward sliding movement of the switch pin through the aperture of the insulator into direct contact with the base of the battery completes the circuit in a manner for current to pass through the spring to the switch pin directly to the base of the battery, said movable means being adapted to complete the circuit upon closure of the breech assembly, and wherein the rear end of the switch pin has an axial opening for receiving the firing pin of the gun without affecting said circuit means.

2. The flashlight according to claim 1 and the flashlight means including annular means embracing the bulb and traversing the interior of the case adjacent the open front end, the annular means being anchored against the case to retain the bulb and battery stationary in the case.

3. The flashlight according to claim 1 wherein the case has a plastic sidewall, the holder including an electrically conductive shank extending along the battery and contactable by the switch pin on inward sliding movement thereof.

4. The flashlight according to claim 3 wherein the holder also has a flange in the shank and confronting the base of the battery, said insulator being between the flange and the base of the battery.

5. The flashlight according to claim 3 and an anchoring disc traversing and engaging the sidewall in embracing relation to the bulb and bearing against the holder to retain the flashlight means in the case.

6. A gun bore sighting flashlight for insertion into the cartridge chamber at the rear end of a gun barrel and to be confined as the breech is closed, said gun including a breach assembly comprising an elongate round case with opposite base and front ends and a sidewall to fit snugly into such a cartridge chamber, the case having configured means limiting forward movement in the chamber during seating of the case therein and also accommodating ejecting the case from the chamber, the configured means including a peripheral rim at the base end, the front end having a forwardly oriented opening to align with the bore of the barrel, and the base end having a base opening extending concentrically and axially therethrough, interruptible flashlight circuit means cooperating with the case to cast a beam of light forwardly from the front end of the case and long the bore of the barrel, said flashlight means including a bulb adjacent the open front end of the case, a mounting in the case for the bulb, a battery in the case providing power for the bulb, an insulator traversing the base of the battery and having a central aperture therein, and movable means consisting of two elements for completing the circuit means, one of said elements being a switch pin in the base opening of the case and guided by the walls of the base opening for sliding movement therethrough, and the other of said movable elements being a spring normally biasing the switch pin to project outwardly of the base end of the case, the spring having one end anchored within the case in continuous circuit connected relationship and the other end anchored to the switch pin so that inward sliding movement of the switch pin through the aperture of thc insulator into direct contact with the base of the battery completes the circuit in a manner for current to pass through the spring to the switch pin directly to the base of the battery, said movable means being adapted to complete the circuit upon closure of the breech assembly, and wherein the rear end of the switch pin has an axial opening for receiving the firing pin of the gun without affecting said circuit means.

* * * * *